US007510450B1

(12) United States Patent
Dresher

(10) Patent No.: US 7,510,450 B1
(45) Date of Patent: Mar. 31, 2009

(54) MOUNTING SYSTEM FOR A TRANSOM MOUNTED TROLLING MOTOR

(75) Inventor: Joshua L. Dresher, Tulsa, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/985,920

(22) Filed: Nov. 19, 2007

(51) Int. Cl.
*B63H 5/125* (2006.01)

(52) U.S. Cl. ..... 440/63; 248/231.31

(58) Field of Classification Search ..... 114/364; 440/6, 53, 60, 63; 248/231.31, 642
See application file for complete search history.

(56) References Cited

U.S. PATENT DOCUMENTS

| | | | | |
|---|---|---|---|---|
| 3,304,720 | A * | 2/1967 | Craig | 248/231.31 |
| 3,840,840 | A | 10/1974 | Izraeli | 339/266 G |
| 3,964,738 | A | 6/1976 | Owen | 269/221 |
| 4,296,922 | A | 10/1981 | McGrath et al. | 269/211 |
| 4,498,872 | A | 2/1985 | Shonley et al. | 440/63 |
| 4,819,922 | A | 4/1989 | Boike | 269/45 |
| 4,854,902 | A | 8/1989 | Havins | 440/7 |
| 4,964,648 | A | 10/1990 | Berkowitz | 280/304.5 |
| 5,005,798 | A | 4/1991 | McCoy | 248/642 |
| 5,358,434 | A | 10/1994 | Brown | 440/60 |
| 5,389,017 | A | 2/1995 | Huzjak | 440/53 |
| 5,669,794 | A * | 9/1997 | Knight et al. | 440/63 |
| 6,053,471 | A | 4/2000 | Brown | 248/642 |
| 6,450,555 | B1 | 9/2002 | Collister et al. | 292/210 |
| 6,758,705 | B1 | 7/2004 | Bechtel et al. | 440/7 |
| 6,862,961 | B2 | 3/2005 | Winkler | 81/367 |
| 7,004,803 | B2 | 2/2006 | Ruffe | 440/53 |
| 2006/0025025 | A1 * | 2/2006 | Kitani et al. | 440/6 |

* cited by examiner

*Primary Examiner*—Lars A Olson
(74) *Attorney, Agent, or Firm*—William D. Lanyi

(57) ABSTRACT

A trolling motor is provided with an over-center clamping mechanism that facilitates its connection to a transom of a marine vessel. First and second clamping elements move toward or away from each other in response to manual manipulation of a handle. The use of an over-center mechanical arrangement allows quick and reliable attachment and removal of the clamping mechanism from the transom.

19 Claims, 5 Drawing Sheets

MOUNTING SYSTEM FOR A TRANSOM MOUNTED TROLLING MOTOR

BACKGROUND OF THE INVENTION

1. Field of the Invention

The present invention is generally related to a mounting system for a trolling motor and, more particularly, to a mounting system that clamps the trolling motor to a transom, or other fixture, of a marine vessel and allows for a quick connect and disconnect to the transom.

2. Description of the Related Art

Those skilled in the art of trolling motors are familiar with many types of mounting systems to attach the trolling motor to a marine vessel. Some attachment systems are particularly configured to attach the trolling motor to the deck of a boat, usually near the bow. These are referred to as bow mounted motors. Other trolling motors are particularly configured to be attached at the rear or side of a marine vessel. These are typically attached to the transom of a boat and are referred to transom mounted motors. A preferred embodiment of the present invention, which will be described below, relates primarily to transom mounted trolling motors.

U.S. Pat. No. 4,498,872, which issued to Shonley et al. on Feb. 12, 1985, describes a lifesaver trolling motor mount. It is a device for connecting the upper end of an auxiliary motor mount to the stern of an inboard/outboard boat when used in conjunction with a mount with pivotal lower anchoring device on the sterndrive.

U.S. Pat. No. 4,854,902, which issued to Havins on Aug. 8, 1989, describes a boat speed and direction control system. It describes a steering control system for a boat propelled by either bow mounted or transom mounted trolling motors. The steering control system includes a steering cam assembly, actuating device for imparting relative rotational movements between the steering cam and the steering cam housing, and steering device for turning the trolling motors in a manner responsive to the actuation of the switching device.

U.S. Pat. No. 5,005,798, which issued to McCoy on Apr. 9, 1991, describes a trolling motor mount. The mount is intended for dynamically attaching an auxiliary trolling motor at a user selective position over the gunwale, transom, or stern of a fishing boat. The mount comprises a rigid bracket secured by a screw clamp to the wall of the boat. The bracket comprises a pair of sides spaced apart by a planar top. A bottom projects inwardly toward the open interior of the brackets. An adjustable base associated with the bracket bottom provides width compensation to accommodate different mounting surfaces.

U.S. Pat. No. 5,358,434, which issued to Brown on Oct. 25, 1994, describes a mounting apparatus for a trolling motor. It is intended for mounting an auxiliary motor such as a trolling motor to the transom of a boat. The apparatus includes a frame, a motor mount, a pivot connection between the frame and the motor mount, a control motor supported by the frame, a gear carried by the frame and driven by the control motor, and a linking arm connected between the gear and the motor mount.

U.S. Pat. No. 5,389,017, which issued to Huzjak on Feb. 14, 1995, describes a folding transom boat. The folding transom has an engaged position and a retracted position. The transom including a motor mounting bracket, a pair of parallel horizontal legs, having first and second ends, each leg being attachable to a boat at the first end, a pair of L-shaped members, maintained in parallel relationship, each of which is rotatably attached at one end of the L-shaped member to the second end of a horizontal leg by a thumb screw for locking the L-shaped member into an engaged position and on the other end of the L-shaped member to the motor mounting bracket.

U.S. Pat. No. 6,053,471, which issued to Brown on Apr. 25, 2000, describes a convertible tilt bracket assembly for mounting trolling motors. The assembly comprises two separable main components, a tilt bracket and a swivel plate. The assembly is convertible for use with any one of various types of trolling motors adapted for bow or transom mounting and it convertibly mounts to a bow gunwale, transom or deck of any of a variety of small fishing boats. In addition, it has as tilt mechanism which minimizes the damaging effect of an underwater impact to a trolling motor of either mounting type.

U.S. Pat. No. 6,758,705, which issued to Bechtel et al. on Jul. 6, 2004, describes a foot pedal kit for a trolling motor. A kit is provided permitting a retrofit conversion of an existing trolling motor to a foot pedal operation. The kit includes a foot pedal assembly, linking mechanical and electrical cables, and attachment hardware including brackets for attaching the mechanical cable to the trolling motor shaft.

U.S. Pat. No. 7,004,803, which issued to Ruffe on Feb. 28, 2006, describes an outboard trolling motor deployment and control system. The system is intended for use with a boat which is afloat in a body of water and includes an outboard trolling motor assembly having at least one, but preferably, one pair of trolling motors. A deployment assembly is disposed in cooperative engagement with the outboard trolling motor assembly and is structured to facilitate positioning the outboard trolling motors between a stowed position and at least one predetermined deployed position.

Many types of over-center mechanisms are known to those skilled in the art. The most popular type of over-center clamping device is used in conjunction with vice grips or other similar type tools. These devices typically operate by having a handle move two clamping surfaces toward each other and, upon further movement of the handle, the clamping surfaces are locked in position. Numerous applications of these types of application of devices are well known to those skilled in the art.

U.S. Pat. No. 3,840,843, which issued to Izraeli on Oct. 8, 1974, describes a quick release grounding clamp. The device is directed to a quick release grounding clamp fabricated basically from an over-center type locking wrench which can be remotely released when a force is exerted upon the conductive cable employed for grounding purposes.

U.S. Pat. No. 3,964,738, which issued to Owen on Jun. 22, 1976, describes a clamp. A pair of work engaging jaws of a clamp device are interconnected by linkages forming part of a manually operable force multiplying mechanism. A movable work engaging element mounted by one of the jaws is actuated by a grip lever from a retracted position into engagement with a workpiece. An over-center linkage transmits the actuating force against the resistance of a spring to prevent return of the grip lever from its actuated position.

U.S. Pat. No. 4,296,922 which issued to McGrath et al. on Oct. 27, 1981, describes a bench clamp device. A tension clamping device is described, which is particularly suited for use as a bench clamp or vice. A workpiece is gripped in the jaws of the clamping device by forcing a pin, which engages notches in an area depending from one of the jaws, to travel in guiding slots until the workpiece is firmly gripped, then holding the pin in this position by an over-center action of the lever controlling the movement of the pin.

U.S. Pat. No. 4,819,922, which issued to Boike on Apr. 11, 1989, describes a clamping apparatus. A clamping system is disposed for use with an assembly gig. It features a clamp having one jaw consisting of a pin and the other jaw including a pad which when closed will be spaced from but parallel to the pin. The pin is to be inserted into a circular locating device which is joined to the frame of the assembly jig.

U.S. Pat. No. 4,964,648, which issued to Berkowitz on Oct. 23, 1990, describes an adapter handle with adjusting mechanism. The handle is intended for use on wheeled vehicles having two spaced apart handles for application of propulsion forces and steering formed by an elongate arm extensible between the spaced apart handles of the wheeled vehicle which includes a clamp adjacent each end thereof to enable the adapter handle to be rapidly coupled onto the spaced apart handles and a single hand grip extending substantially from the center of the arm.

U.S. Pat. No. 6,450,555, which issued to Collister et al. on Sep. 17, 2002, describes a locking squeeze-off clamp. A latching mechanism for an adjustable squeeze-off clamp comprises a static jaw, a movable jaw with an associated adjustment member and an over-center operating linkage including an operating handle and a link. The latching mechanism is selectively automatic whereby, when the lock mode is selected and the clamp is then closed, it automatically locks.

U.S. Pat. No. 6,862,961, which issued to Winkler on Mar. 8, 2005, describes a locking pliers tool with automatic jaw gap adjustment and adjustable clamping force capability. A locking pliers tool which combines a self-locking, frictional brake, gap setting means to set jaw gap size automatically when clamping onto a workpiece, and an over-center linkage clamping means to securely clamp the workpiece in between the opposing tool jaws, and an adjustment means for setting the clamping force to be exerted onto the gripped workpiece is described.

The patents described above are hereby expressly incorporated by reference in the description of the present invention.

It would be significantly beneficial if a clamping mechanism could be provided for attaching a trolling motor to a transom of a marine vessel. It would be particularly helpful if the clamping mechanism was configured to allow the trolling motor to be quickly attached and/or removed from the transom.

SUMMARY OF THE INVENTION

A trolling motor made in accordance with a preferred embodiment of the present invention comprises a first clamping element having a first clamping surface and a second clamping element having a second clamping surface. In addition, it comprises a manually movable handle which is movable between first and second positions. The second clamping element is attached to the first clamping element. The second clamping element is movable relative to the first clamping element. The movement of the handle from the first position toward the second position causes the first and second clamping surfaces to move toward each other and movement of the handle from the second position toward the first position causes the first and second clamping surfaces to move away from each other. Movement of the handle beyond the second position causes the first and second clamping surfaces to become and remain locked in position relative to each other.

In a preferred embodiment of the present invention, the handle is pivotally attached to the second clamping element. The preferred embodiment of the present invention can further comprise a link pivotally connected between the handle and the first clamping element. The link can be adjustable in effective length.

The first and second clamping surfaces are shaped to engage forward and rear surfaces of a transom of a boat or a similar surface of a marine vessel. The first clamping element can be attached to a support member of a trolling motor, such as a generally tubular column which supports an electric motor at its lower portion.

In one embodiment of the present invention, movement of the handle from the first position toward the second position causes a distal end of the handle to move away from the trolling motor and, in an alternative embodiment of the present invention, movement of the handle from the first position toward the second position causes a distal end of the handle to move toward the trolling motor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
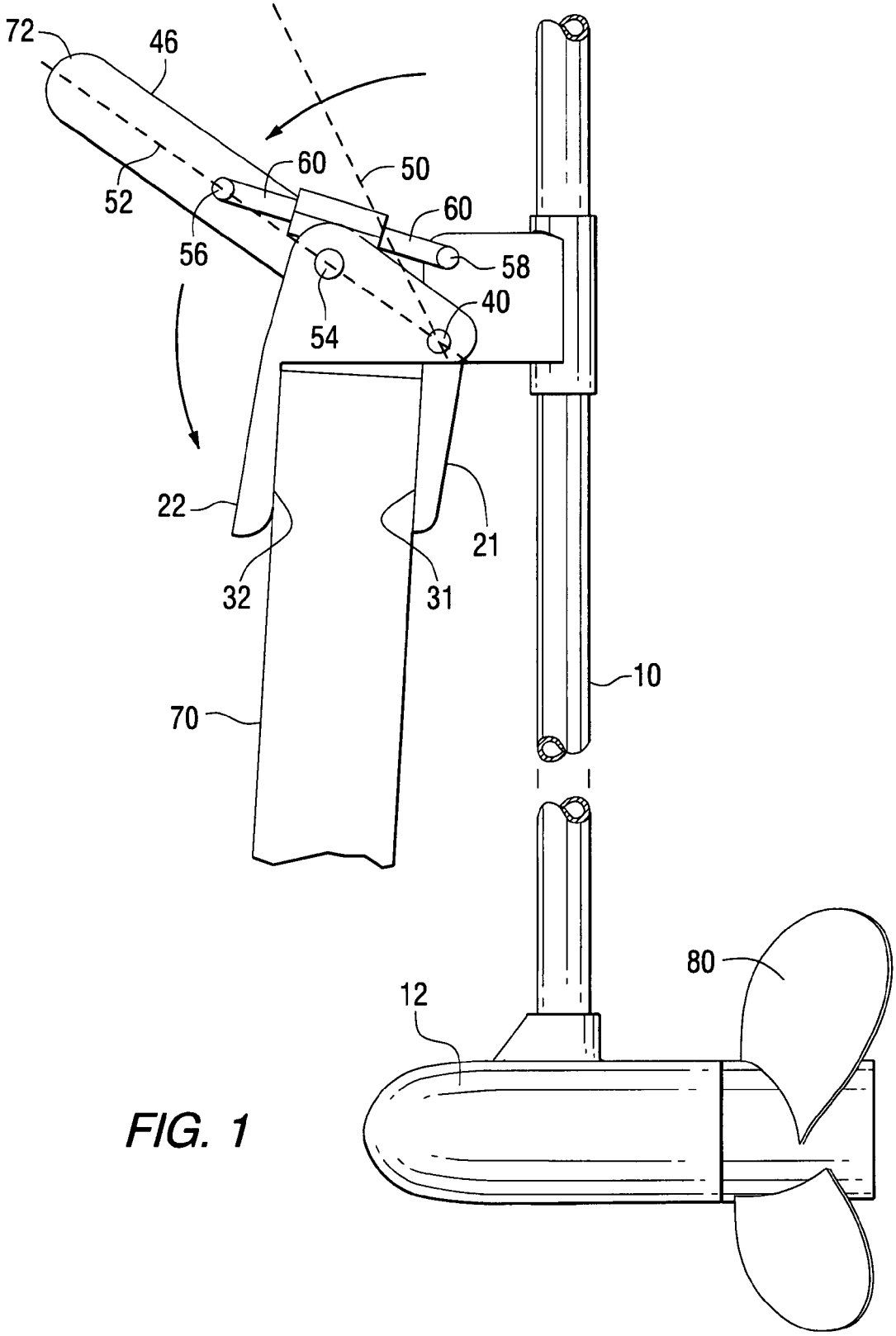
FIG. 1 shows one embodiment of the present invention in which the handle moves away from the trolling motor when moving into a clamping position.

Throughout the description of the preferred embodiment of the present invention, like components will be identified by like reference numerals.

FIG. 1 shows a simplified schematic representation of one embodiment of the present invention. A support shaft 10 provides support for a motor 12 in a manner that is generally well known to those skilled in the art of trolling motors. The support member, or support shaft 10, is shown in FIG. 1 attached to a first clamping element 21 which has a first clamping surface 31. A second clamping element 22 has a second clamping surface 32. The second clamping element 22 is attached to the first clamping element 21 at point 40. The second clamping element 22 is movable relative to the first clamping element 21 because pivot 40 provides a pivotal support between these two components. A manually movable handle 46 is movable between first and second positions. Dashed line 50 represents a first position which is exemplary in nature. It should be clearly understood that the handle 46 is rotatable and, therefore, assumes numerous positions between a fully opened position, where the clamping faces, 31 and 32, are separated to a maximum distance, and a fully closed position where the clamping surfaces are moved to their closest relative position. Dashed line 52 represents the second position. Movement of the handle 46 from the first position 50 toward the second position 52 causes the first and second clamping surfaces, 31 and 32, to move toward each other. Movement of the handle 46 from the second position 52 toward the first position 50 causes the first and second clamping surfaces to move away from each other. Movement of the handle 46 beyond the second position 52 causes the first and second clamping surfaces, 31 and 32, to remain locked in position relative to each other. Those skilled in the art will recognize that the embodiment of the present invention illustrated in FIG. 1 operates in a manner generally similar to the over-center technique used in various tools, such as vice grips.

With continued reference to FIG. 1, various components play a role in the embodiment shown in FIG. 1. For example, pivot 54 provides a rotatable connection between the handle 46 and the second clamping element 22. Pivot 56 and pivot 58 provide rotatable connection points between the handle and a link 60 and between the link 60 and the first clamping element 21. Link 60 is configured to be changeable in length. This type of link, often referred to as a turnbuckle, allows the linkage shown in FIG. 1 to be adjusted so that the locking position, when the handle 46 is moved to or beyond the second position 52, can be selected as a function of the length of link 60.

With continued reference to FIG. 1, it can be seen that the trolling motor shown in the illustration is intended for use as a transom mounted trolling motor. The transom 70 is illustrated between the first and second clamping surfaces, 31 and 32. To loosen the attachment between the trolling motor and the transom 70, the handle 46 would be moved in a clockwise direction in FIG. 1 toward the first position 50. It should be understood that the illustration in FIG. 1 is highly exemplary and schematic and intended to show the basic manner in which an over-center linkage system is incorporated by this embodiment of the present invention. It can be seen that a distal end 72 of the handle 46 moves away from the support column 10 of the trolling motor as it moves into the locking position. The opposite could also be true in alternative embodiments of the present invention.

Figure 2:
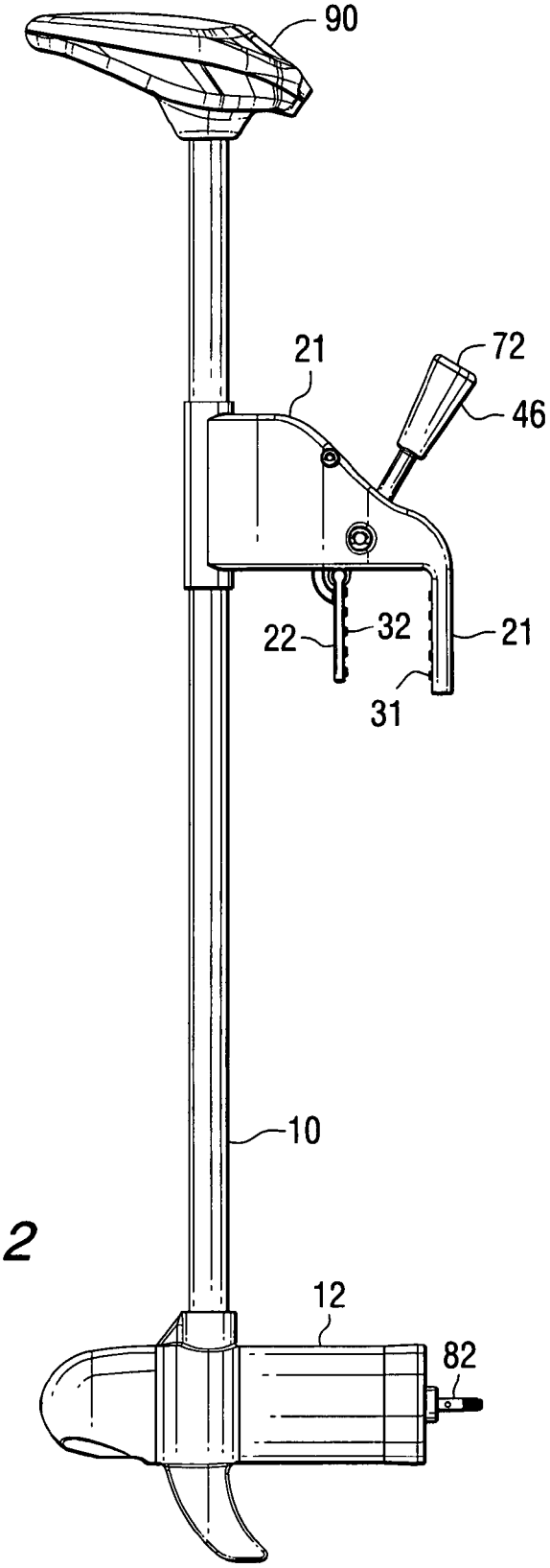
FIG. 2 shows an alternative embodiment of the present invention in which the handle moves toward the trolling motor to cause the clamping mechanism to lock onto a transom of a marine vessel.

FIG. 2 is a side view of an alternative embodiment of the present invention. The support column 10 provides support for the motor 12. A propeller 80, which is illustrated in FIG. 1, is not shown in FIG. 2, but it should be understood that the propeller shaft 82 is shaped to receive a propeller. A control head 90 is also illustrated in FIG. 2. The first clamping element 21 also provides attachment to the support column 10, as shown in FIGS. 1 and 2. The first and second clamping surfaces, 31 and 32, are configured to grip opposite surfaces of a transom (not shown in FIG. 2) when the handle 46 is moved from the first to the second position and locked in position.

Figure 3:
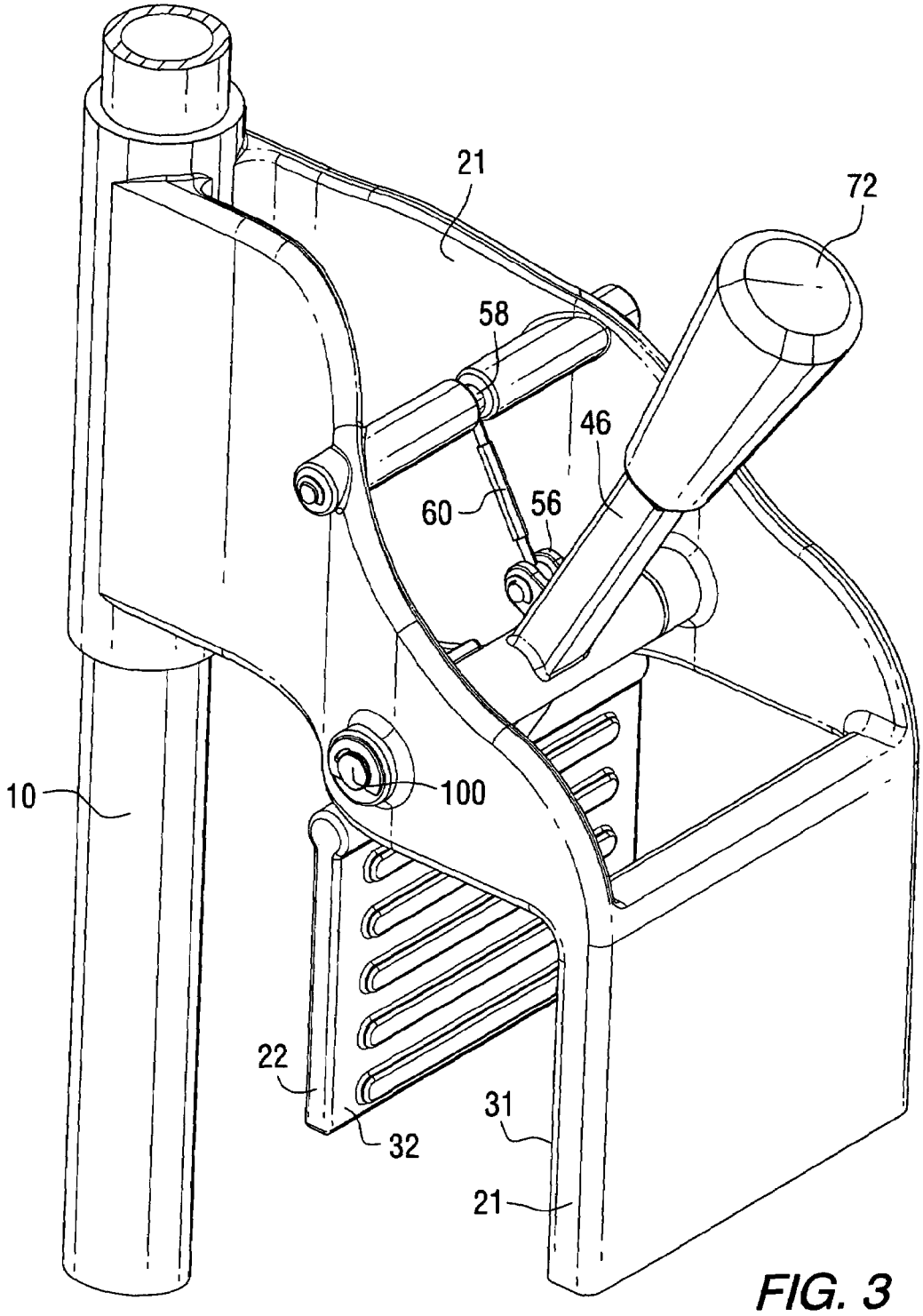
FIG. 3 is an isometric view of a portion of the trolling motor shown in FIG. 2.

FIG. 3 is an isometric view of a portion of the trolling motor described above in conjunction with FIGS. 1 and 2. The first clamping element 21 is attached to the support column 10 as described above. The handle 46 is pivotable at point 100 about an axis that is attached to the first clamping element 21. The link 60, which is a turnbuckle, is connected to the handle at point 56 and connected to the first clamping element at point 58. As illustrated in FIG. 3, the handle 46 is nearer its first position 50, as discussed above in conjunction with FIG. 1, than its second position 52, or locking position. Movement of the handle 46 from the position shown in FIG. 3 upward and toward the support column 10 will move the clamping surfaces, 31 and 32, toward each other and will eventually lock them in position against a transom disposed between the clamping surfaces.

Figure 4:
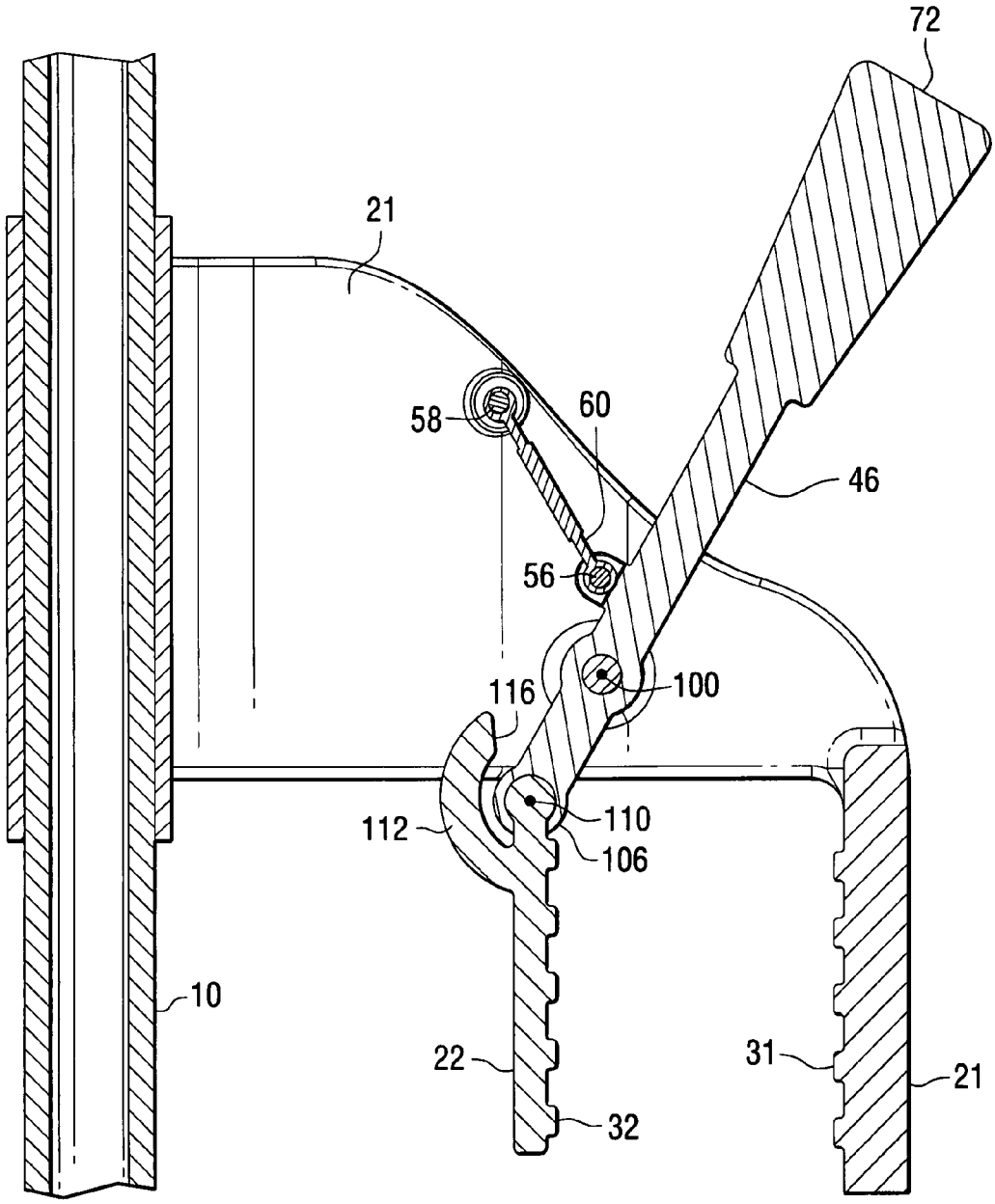
FIG. 4 is a sectioned view of the mechanism of the present invention.

FIG. 4 is a side cutaway view showing the handle 46 connected, at point 100, to the first clamping element 21 and to the link 60. The link 60 is connected to the handle at point 56 and connected to the first clamping element 21 at point 58. At the end portion 106 of the handle 46, where it is connected to the second clamping element 22, the connection at axis 110 is not a rigid one in the embodiment shown in FIGS. 2-4. Instead, the second clamping element 22 is pivotable about axis 110. The semi-circular portion 112 of the second clamping element 22 is provided with a contact face 116 which is shown to move into contact with a portion of the handle 46 as will be described in greater detail below. In FIG. 4, the handle 46 is in its first position which does not lock the first and second clamping elements, 21 and 22, in relation to each other. However, movement of the handle 46 in a counter-clockwise direction about axis 100, will cause the first and second clamping surfaces, 31 and 32, to move toward each other and, eventually, to lock into position relative to each other when the handle 46 is moved to and beyond its second position.

Figure 5:
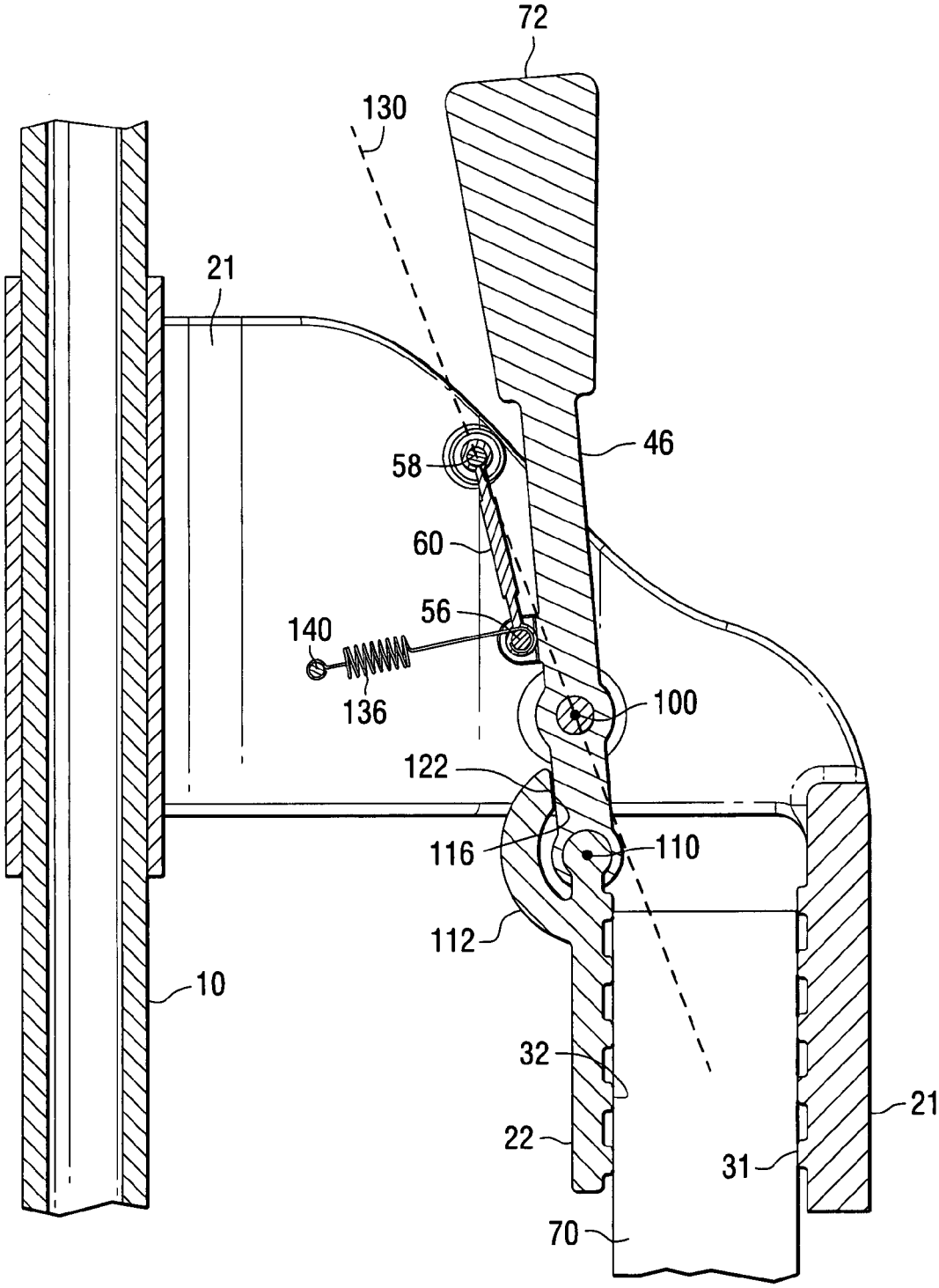
FIG. 5 is generally similar to FIG. 4 but with the handle and clamping component in their locked positions.

FIG. 5 is generally similar to FIG. 4, but with the handle 46 moved to and beyond its second position in order to lock the first and second clamping elements, 21 and 22, together with their clamping faces, 31 and 32, in contact with the transom 70. As can be seen in FIG. 5, the semi-circular portion 112 of the second clamping element 22 has moved into contact with the handle 46. Its contact surface 116 has moved into contact with a portion 122 of the surface of the handle 46. The second clamping element 22 has rotated about axis 110 at its support by the handle 46 and this arrangement provides a clamping force between the second clamping surface 32 and a rearward surface of the transom 40. When in the position shown in FIG. 5, the first and second clamping elements, 21 and 22, are locked in position relative to each other. In FIG. 5, dashed line 130 is provided to show the alignment between pivots 58 and 100 and the relationship between that alignment and the location of pivot 56 which connects the link 60 to the handle 46. In FIG. 5, that arrangement is in an over-center condition which serves to lock the elements into the position shown. Although not necessary in all embodiments of the present invention, a spring 136 is shown connected schematically between point 56 and a point 140 attached to the first clamping element 21. This spring 136 can serve to urge the handle 46 toward the position shown in FIG. 5 and to retain the handle 46 in that position. Although not necessary in all embodiments of the present invention, the use of this spring 136 can prove to be beneficial if the trolling motor is subjected to impact loads that might otherwise cause the handle 46 to move out of its locked position shown in FIG. 5.

The present invention is intended to provide a quick and reliable structure that can be attached to a transom of a marine vessel. Rather than use thumb screws or other devices that require significantly more time to make the connection between the trolling motor and the transom, the present invention provides a structure that allows a quick and reliable attachment to the transom with a smooth motion of a manually movable handle.

With continued reference to FIGS. 1-5, it can be seen that a trolling motor 12 made in accordance with a preferred embodiment of the present invention comprises a first clamping element 21 having a first clamping surface 31, a second clamping element 22 having a second clamping surface 32, and a manually movable handle 46 which is movable between first and second positions, 50 and 52. The second clamping element 22 is attached to the first clamping element 21 and the second clamping element 22 is movable relative to the first clamping element 21. Movement of the handle 46 from its first position toward its second position causes the first and second clamping surfaces, 31 and 32, to move toward each other. Movement of the handle in the opposite direction from the second position toward the first position causes the first and second clamping surfaces to move away from each other. When the handle 46 is moved beyond the second position 52, this causes the first and second clamping surfaces, 31 and 32, to remain locked in position relative to each other. This is accomplished through the use of the well known over-center locking mechanisms that are used in many different types of hand tools.

The handle 46 is pivotally attached at point 54 to the second clamping element 22. A link 60 is pivotally connected between the handle 46 and the first clamping element 21. The link 60 is adjustable in effective length, as illustrated by the use of a turnbuckle in the figures. The first and second clamping surfaces, 31 and 32, are shaped to engage forward and rear surfaces of a transom 70 of a boat. The first clamping element 21 is attached to a support member 10 of the trolling motor 12. The support member 10 of the trolling motor 12 is a generally tubular column in a preferred embodiment of the present invention and it supports the electric motor at its position. Movement of the handle 46 from the first position toward the second position can cause a distal end 72 of the handle 46 to move away from the trolling motor as illustrated in FIG. 1. In alternative embodiments of the present invention, movement of the handle 46 from the first position toward the second position can cause the distal end 72 of the handle to move toward the trolling motor 10.

Although the present invention has been described with particular detail and illustrated to show a specific embodiment, it should be understood that alternative embodiments are also within its scope.

I claim:

1. A trolling motor, comprising:

a first clamping element having a first clamping surface;

a second clamping element having a second clamping surface, said second clamping element being attached to said first clamping element, said second clamping element being movable relative to said first clamping element;

a manually movable handle which is movable between first and second positions, whereby movement of said handle from said first position toward said second position causes said first and second clamping surfaces to move toward each other, movement of said handle from said second position toward said first position causes said first and second clamping surfaces to move away from each other, and movement of said handle beyond said second position causes said first and second clamping surfaces to remain locked in position relative to each other; and a link pivotally connected between said handle and said first clamping element.

2. The trolling motor of claim 1, wherein:

said handle is pivotally attached to said second clamping element.

3. The trolling motor of claim 2, wherein:

said first clamping element is attached to a support member of said trolling motor.

4. The trolling motor of claim 3, wherein:

said support member of said trolling motor is a generally tubular column which supports an electric motor at its lower portion.

5. The trolling motor of claim 1, wherein:

said link is adjustable in effective length.

6. The trolling motor of claim 1, wherein:

said first and second clamping surfaces are shaped to engage forward and rear surfaces of a transom of a boat.

7. The trolling motor of claim 1, wherein:

movement of said handle from said first position toward said second position causes a distal end of said handle to move away from said trolling motor.

8. The trolling motor of claim 1, wherein:

movement of said handle from said first position toward said second position causes a distal end of said handle to move toward said trolling motor.

9. A trolling motor, comprising:

a first clamping element having a first clamping surface;

a second clamping element having a second clamping surface, said second clamping element being attached to said first clamping element, said second clamping element being movable relative to said first clamping element, said first and second clamping surfaces being shaped to engage forward and rear surfaces of a transom of a boat;

a manually movable handle which is movable between first and second positions, whereby movement of said handle from said first position toward said second position causes said first and second clamping surfaces to move toward each other, movement of said handle from said second position toward said first position causes said first and second clamping surfaces to move away from each other, and movement of said handle beyond said second position causes said first and second clamping surfaces to remain locked in position relative to each other; and a link pivotally connected between said handle and said first clamping element, said link being adjustable in effective length.

10. The trolling motor of claim 9, wherein:

said handle is pivotally attached to said second clamping element.

11. The trolling motor of claim 9, wherein:

said first clamping element is attached to a support member of said trolling motor.

12. The trolling motor of claim 11, wherein:

said support member of said trolling motor is a generally tubular column which supports an electric motor at its lower portion.

13. The trolling motor of claim 9, wherein:

movement of said handle from said first position toward said second position causes a distal end of said handle to move away from said trolling motor.

14. The trolling motor of claim 9, wherein:

movement of said handle from said first position toward said second position causes a distal end of said handle to move toward said trolling motor.

15. A trolling motor, comprising:

a first clamping element having a first clamping surface, said first clamping element being attached to a support member of said trolling motor;

a second clamping element having a second clamping surface, said second clamping element being attached to said first clamping element, said second clamping element being movable relative to said first clamping element;

a manually movable handle which is movable between first and second positions, whereby movement of said handle from said first position toward said second position causes said first and second clamping surfaces to move toward each other, movement of said handle from said second position toward said first position causes said first and second clamping surfaces to move away from each other, and movement of said handle beyond said second position causes said first and second clamping surfaces to remain locked in position relative to each other, said handle is pivotally attached to said second clamping element; and a link pivotally connected between said handle and said first clamping element, said link being adjustable in effective length.

16. The trolling motor of claim 15, wherein:

said first and second clamping surfaces are shaped to engage forward and rear surfaces of a transom of a boat.

17. The trolling motor of claim 15, wherein:

said support member of said trolling motor is a generally tubular column which supports an electric motor at its lower portion.

18. The trolling motor of claim 15, wherein:

movement of said handle from said first position toward said second position causes a distal end of said handle to move away from said trolling motor.

19. The trolling motor of claim 15, wherein:

movement of said handle from said first position toward said second position causes a distal end of said handle to move toward said trolling motor.

* * * * *